US007724196B2

(12) United States Patent
Kinezos et al.

(10) Patent No.: US 7,724,196 B2
(45) Date of Patent: May 25, 2010

(54) FOLDED DIPOLE MULTI-BAND ANTENNA

(75) Inventors: Christos L. Kinezos, Sunrise, FL (US); Alejandro Candal, Davie, FL (US); Lorenzo A. Ponce De Leon, Lake Worth, FL (US)

(73) Assignee: Motorola, Inc., Schaumburg, IL (US)

( * ) Notice: Subject to any disclaimer, the term of this patent is extended or adjusted under 35 U.S.C. 154(b) by 305 days.

(21) Appl. No.: 11/855,583

(22) Filed: Sep. 14, 2007

(65) Prior Publication Data

US 2009/0073055 A1 Mar. 19, 2009

(51) Int. Cl.
*H01Q 1/24* (2006.01)

(52) U.S. Cl. ..... 343/702

(58) Field of Classification Search ..... 343/702, 343/803, 767, 741, 700 MS, 729, 725
See application file for complete search history.

(56) References Cited

U.S. PATENT DOCUMENTS

| | | | | |
|---|---|---|---|---|
| 6,215,454 | B1 * | 4/2001 | Tran | 343/841 |
| 6,456,249 | B1 * | 9/2002 | Johnson et al. | 343/702 |
| 6,683,582 | B1 * | 1/2004 | Love | 343/853 |
| 6,850,130 | B1 * | 2/2005 | Gottl et al. | 333/161 |
| 2007/0040747 | A1 | 2/2007 | Kinezos | |
| 2008/0167073 | A1 * | 7/2008 | Hobson et al. | 455/557 |

* cited by examiner

*Primary Examiner*—Huedung Mancuso
(74) *Attorney, Agent, or Firm*—Gregory L. Mayback; Scott B. Smiley; Mayback & Hoffman

(57) ABSTRACT

A loop antenna includes a ground plane and a conductive element with a first C-shaped element portion having an open end and a closed end, with only the open end extending directly above a first portion of the ground plane, a second C-shaped element portion having an open end and a closed end, with only the open end extending directly above a second portion of the ground plane, and a transmission line element disposed between the first C-shaped element portion and the second C-shaped element portion and positioned directly above a third portion of the ground plane.

20 Claims, 7 Drawing Sheets

— PRIOR ART —

200

500

FOLDED DIPOLE MULTI-BAND ANTENNA

FIELD OF THE INVENTION

This invention relates in general to wireless devices, and more particularly, to an internal multi-element multi-band antenna for use in hand-held devices.

BACKGROUND OF THE INVENTION

Wireless communication is the transfer of information over a distance without the use of electrical conductors or "wires." This transfer is actually the communication of electromagnetic waves between a transmitting entity and remote receiving entity. The communication distance can be anywhere from a few inches to thousands of miles.

Wireless communication is made possible by antennas that radiate and receive the electromagnetic waves to and from the air, respectively. The function of the antenna is to "match" the impedance of the propagating medium, which is usually air or free space, to the source that supplies the signals sent or interprets the signals received.

Antenna designers are constantly balancing antenna size against antenna performance. Unfortunately, these two characteristics are generally inversely proportional. To make matters more difficult, consumers are now favoring cellular phones with internal antennas. The ever-shrinking size of cellular phones leaves little space inside the phone for these antennas. To add even more complexity to this communication problem, phones are needed that offer communication in multiple modes and in multiple frequency ranges, requiring multiple and differening antenna elements within the phone. With the reduction in antenna element real estate, communication performance suffers.

Therefore, a need exists to overcome the problems with the prior art as discussed above.

SUMMARY OF THE INVENTION

A loop antenna, in accordance with an embodiment of the present invention includes a ground plane and a conductive element with a first C-shaped element portion having an open end and a closed end, with only the open end extending directly above a first portion of the ground plane, a second C-shaped element portion having an open end and a closed end, with only the open end extending directly above a second portion of the ground plane, and a transmission line element disposed between the first C-shaped element portion and the second C-shaped element portion and positioned directly above a third portion of the ground plane.

In accordance with another feature of the present invention, the first C-shaped element portion has a first end, the second C-shaped element portion has a second end and the transmission line element is in a series connection between the first end of the first C-shaped element portion and the second end of the second C-shaped element portion.

In accordance with a further feature of the present invention, the first C-shaped element portion is symmetrical with the second C-shaped element portion.

In accordance with a yet another feature, the present invention includes a stub element coupled to the conductive element at a feedpoint of the conductive element and one of generally follows the shape of one of the C-shaped element portions and meanders in a proximity of one of the C-shaped element portions.

In accordance with a yet another feature, the present invention includes a handset supporting and containing the element and the ground plane, the handset having a first side to face a user's head during use and a second side to face a user's hand during use, wherein the ground plane is disposed between the first side and the second side and the element is disposed between the first side and the ground plane.

The present invention, according to an embodiment, is a wireless communication device that includes a first side with user-interactable components, a second side to be supported by a user's hand, a ground plane disposed between the first side and the second side and having outer edges, and a conductive element located between the first side and the ground plane. The conductive element includes a first element portion forming a C-shape with an open end directly above a first portion of the ground plane and a closed end extending beyond at least one edge of the ground plane, a second element portion forming a C-shape with an open end directly above a second portion of the ground plane and a closed end extending beyond at least one edge of the ground plane, and a transmission line element connecting the first element portion to the second element portion and positioned directly above a third portion of the ground plane.

BRIEF DESCRIPTION OF THE DRAWINGS

The accompanying figures, where like reference numerals refer to identical or functionally similar elements throughout the separate views, and which together with the detailed description below are incorporated in and form part of the specification, serve to further illustrate various embodiments and to explain various principles and advantages all in accordance with the present invention.

DETAILED DESCRIPTION

Figure 1:
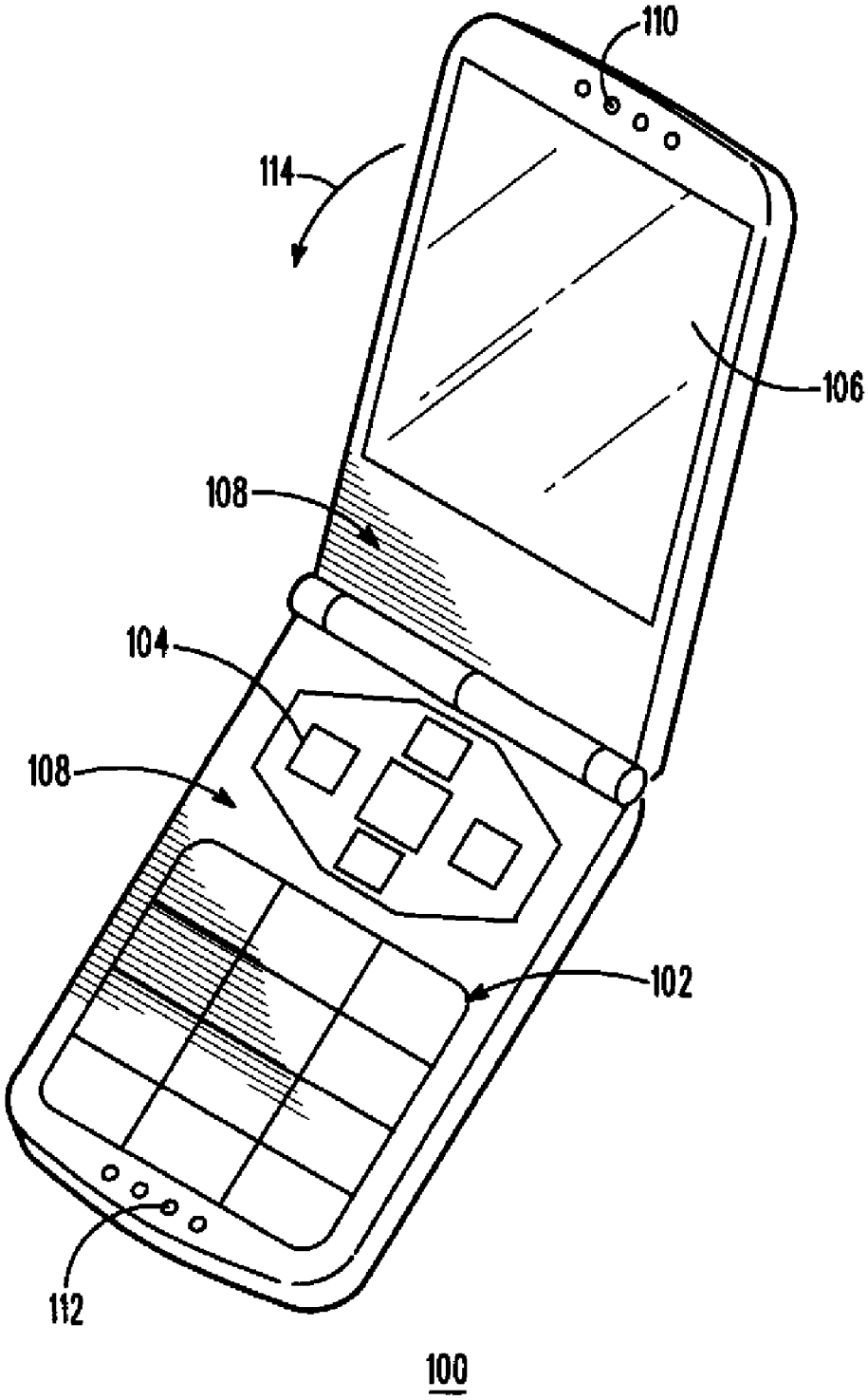
FIG. 1 is a perspective view of a prior-art cellular device.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The present invention provides a novel and efficient multi-band antenna structure that includes an asymmetrical λ/2 (half wavelength) folded dipole element and a λ/4 (quarter wavelength) resonant stub element. The elements share a common feeding point and utilize a common grounding plane. The invention is advantageous in that it allows for a reduction of the area normally needed for a λ/2 antenna element, without interfering with Radio Frequency (RF) performance.

An antenna is a transducer designed to transmit or receive radio waves, which are a class of electromagnetic waves. In other words, antennas convert radio frequency electrical currents into electromagnetic waves, and vice versa. Antennas are used in systems such as radio and television broadcasting, point-to-point radio communication, wireless LAN, radar, and space exploration.

Physically, an antenna is a conductor that generates a radiating electromagnetic field in response to an applied alternating voltage and the associated alternating electric current. Alternatively, an antenna can be placed in an electromagnetic field so that the field will induce an alternating current in the antenna and a voltage between its terminals. It is through these antennas that electronic wireless communication is made possible.

The electromagnetic (EM) "spectrum" is the range of all possible electromagnetic radiation. This spectrum is divided into frequency "bands," or ranges of frequencies, that are designated for specific types of communication. Many radio devices operate within a specified frequency range, which limits the frequencies on which the device is allowed to transmit. The lower and upper-bound frequencies are the points at which signal strength of the device falls off by 3 dB.

EM energy at a particular frequency (f) has an associated wavelength (λ). The relationship between wavelength and frequency is expressed by:

$$\lambda = c/f$$

where c is the speed of light (299,792,458 m/s). It therefore follows that high-frequency EM waves have a short wavelength and low-frequency waves have a longer wavelength.

The Integrated Digital Enhanced Network (iDEN) is a mobile telecommunications technology, developed by Motorola, Inc., of Schaumberg, Ill., which provides its users the benefits of a trunked radio and a cellular telephone. iDEN places more users in a given spectral space, as compared to analog cellular and two-way radio systems, by using speech compression and Time Division Multiple Access (TDMA). iDEN is designed and licensed to operate in the frequency band starting at 806 MHz up to and including 941 MHz. In addition to the iDEN band there are other bands in the 825-960 MHz frequency range that are used by cellular systems. For purposes of lexography the combined range of frequencies from 806-960 MHz will be designated as the "cellular band." The present invention provides a λ/2 antenna element that efficiently operates in the cellular band frequency range.

The Global Positioning System (GPS) is currently the only fully-functional Global Navigation Satellite System (GNSS). Utilizing a constellation of at least 24 Earth orbiting satellites that transmit precise microwave signals, the GNSS enables a GPS receiver to determine its location, speed, and direction. The present invention includes a GPS element that that is tuned to receive GPS signals at the frequency of 1575.42 MHz and can also be tuned (if desired) to the 1800-1990 MHz Personal Communications System (PCS) frequency bands.

FIG. 1 shows a cellular phone 100, also referred to as a "handset." The phone 100 has user-interactable components, such as a keypad 102 for dialing numbers and entering characters and digits, a display screen 106, and a selection pad 104 for making selections, entering responses, navigating graphical user interface menus, and otherwise interacting with the device 100. The view of the phone 100 in FIG. 1 shows a first side 108 of the phone that is intended to be placed against a user's head during use. The cellular phone 100 has a speaker 110 and a microphone 112 and is intended to be oriented so that, in use, the microphone 112 is positioned in proximity to the user's mouth and the speaker 110 is positioned in proximity to the user's ear. The back side of the phone 100, which cannot be seen in the view in FIG. 1, is the side of the phone 100 that faces the user's hand during use.

The particular cellular phone 100 is a well-known "clamshell" device, where the term "clamshell" refers to the way the phone 100 folds 114 and places the display screen 106 directly above the keypad 102 when closed. This folding feature not only makes the device smaller and easily transportable, it also protects the display screen from damage. The present invention, however, is not limited to clamshell designs or to any particular type or configuration of cellular phone.

Figure 2:
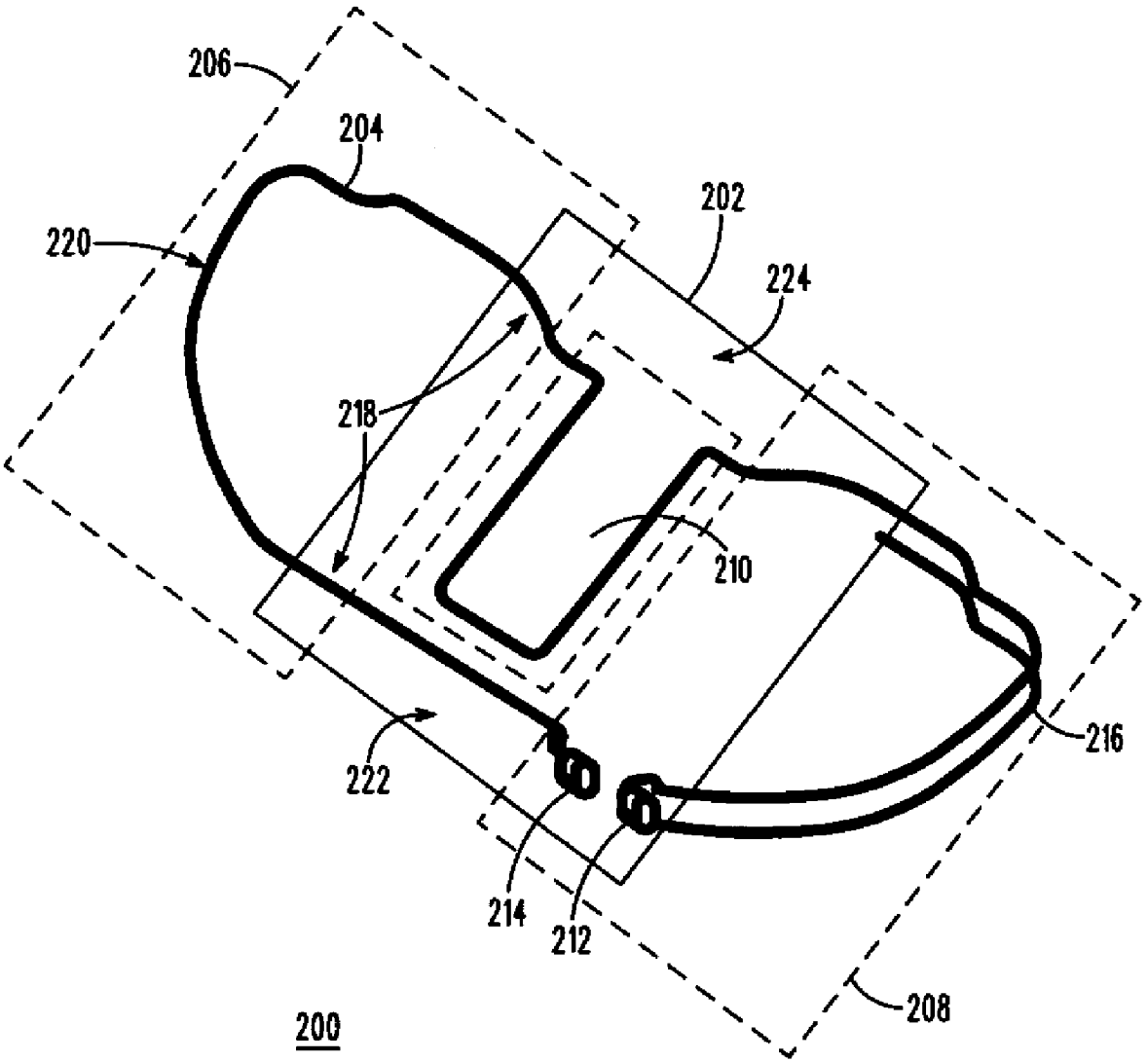
FIG. 2 is a perspective view of a dual-element/multi-frequency band antenna, according to an embodiment of the present invention.

FIG. 2 shows a first embodiment of an antenna in accordance with the present invention. The antenna 200 includes a ground plane 202 and a first cellular band element 204 spaced above the ground plane 202 with portions of the cellular band element 204 positioned directly above the ground plane 202 and other portions extending away from the ground plane 202. The term "directly above," as used herein, is defined as intersecting with any line in a set of lines that are orthogonal to the surface of the ground plane 202 and extend from a perimeter of the ground plane 202.

The element 204 can be of any suitable radiating material. The cellular band element 204 includes two generally C-shaped element portions 206 and 208, which, together, efficiently operate in frequency ranges covering the cellular band. A C-shaped portion, as defined herein, is any shape where two points along the length of the element cross a single plane, with a curved portion being disposed between the two points. In addition to the curved portion, the length between the two points that cross the plane can also include one or more line segments or other curves.

Each of the generally C-shaped portions 206 and 208 is oriented so that the open end 218 of the C-shape is positioned directly above a portion of the ground plane 202 and the closed, or curving, part 220 of the C-shape extends away from the ground plane 202. More specifically, the open end 218 of the first C-shaped portion 206 extends above a first portion of the ground plane 202, the first portion of the ground Diane being that part of the around plane 202 shown in FIG. 2 that overlaps with the dotted line indicating the first C-shaped portion 206. Likewise, the open end of the second C-shaped portion 208 extends above a second portion of the ground plane 202. The second portion of the ground plane is that Part of the ground plane 202 shown in FIG. 2 that overlaps with the dotted line indicating the second C-shaped portion 208. In this configuration, only part of the cellular band element 200 feels the full effect of the ground plane 202. The cellular band element 200 has a feed point 212, where the element 200 is energized, and a ground point 214, where the element 200 is shorted to the ground plane 202. The ground point 214 is the only place where the element 204 makes direct electrical contact with the ground plane 202.

The ground plane 202 is defined as "partial" because it is smaller than the element 204 to which it is coupled in the region where the antenna element portions reside. The ground plane 202 is further defined as having a connecting end 222 where the antenna 200 connects to the ground plane 202 and an opposite end 224 that extends over a region beyond the antenna element 204. In the region 224 beyond the antenna elements 204, the ground plane 202 can take on any arbitrary shape and can be larger than the antenna element.

A transmission line element 210 is provided between the first C-shaped portion 206 and the second C-shaped portion 208 and is positioned so that the entire transmission line element 210 is directly above a third portion of the ground plane 202. The third portion of the ground plane 202 is shown in FIG. 2 as that portion of the ground plane defined by the dashed line indicating transmission line element 210 and located between the first portion of the ground plane 202 and the second portion of the ground plane 202. As can be seen in FIG. 2, the transmission line element 210 is sandwiched between the two C-shaped element portions 206 and 208 and is in an electrical series path between the feed point 212 and the ground point 214.

The transmission line element 210 is a reactive distributive element that provides length to the overall element 200 as well as electromagnetic coupling to the ground plane 202. The added length provided by the transmission line element 210 extends the overall element length closer to the desirable λ/2 dimension. The electromagnetic coupling provided by the transmission line element 210 also makes the element electrically appear taller than it is, which helps "match" the antenna element 200 to the impedance of air. In this particular embodiment, the transmission line element 210 is rectangular in shape, although the invention is not so limited and can be, for example, square or curved.

In the particular embodiment shown in FIG. 2, the two general C-shaped portions 206 and 208 are substantially mirror symmetrical. However, symmetry between the C-shapes is not necessary and the present invention is not so limited. The dotted lines in FIG. 2 generally defines the boundaries of the C-shapes, but are not meant to be exact.

Figure 3:
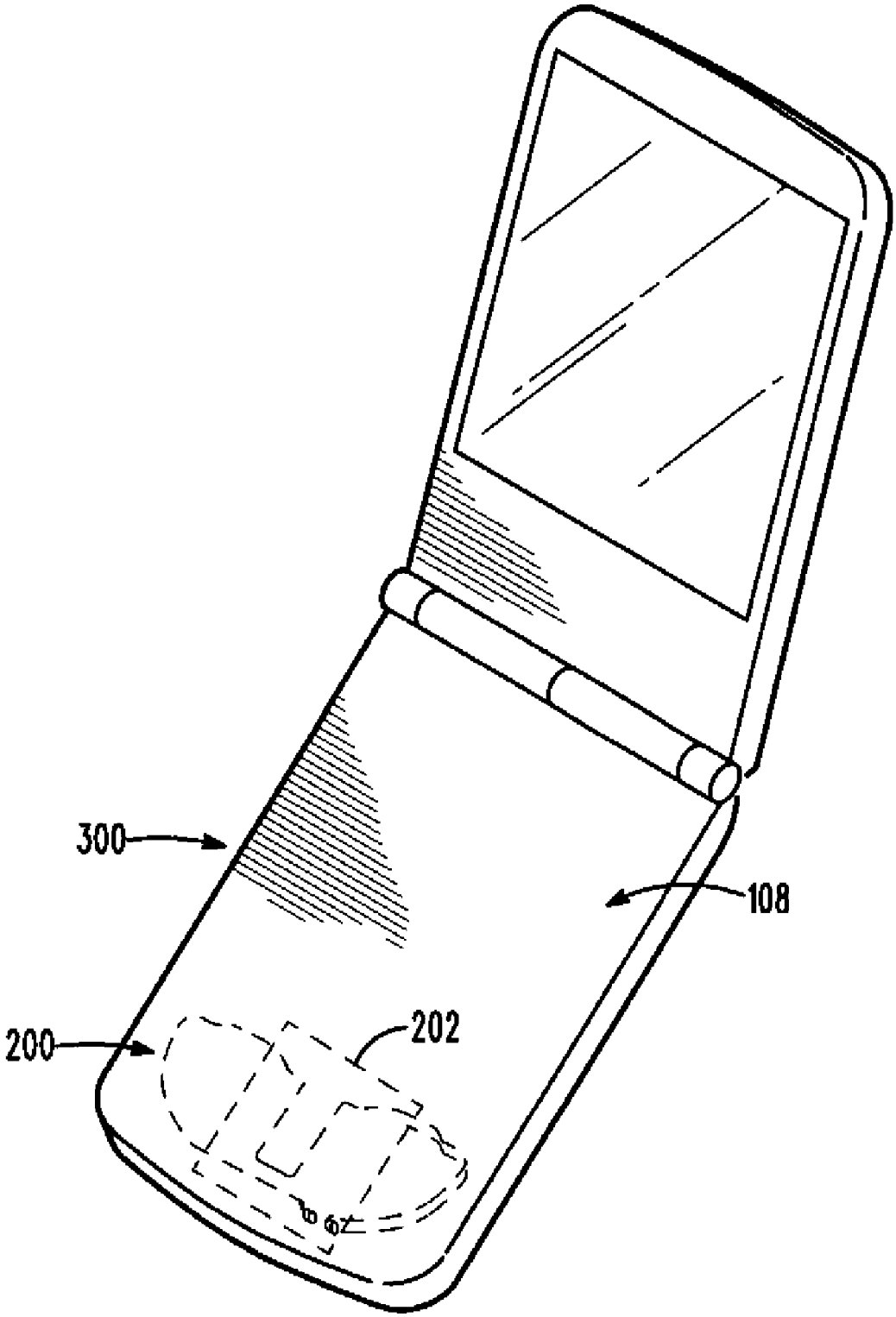
FIG. 3 is a fragmentary, partially hidden, perspective view of the dual-element/multi-frequency band antenna of FIG. 2 diagrammatically placed within a cellular communication device, according to an embodiment of the present invention.

FIG. 3 shows a partially hidden perspective view of a phone 300 with an antenna 200 located internally within the phone 300, the antenna being illustrated only diagrammatically. As shown in detail in FIG. 2, the exemplary embodiment of the antenna 200 is a folded dipole implemented on top of a partial ground plane 202. The primary resonance, Transmission Line Mode (TLM), covers the low band. The primary resonance or TLM is defined as the mode of operation where the current distribution along the structure exhibits one maximum and the feed point impedance is real or resistive. This establishes the lowest frequency of operation for the antenna which is designated as the low band. In this embodiment, the low band constitutes the iDEN frequencies ranging from 806-941 MHz, however, the invention is not so limited. The antenna can also be configured to cover the GSM bands from 825-960 MHz. This particular configuration (λ/2 size and positioning within the phone) presents advantages over traditional λ/4 antennas. One advantage is that the antenna excites fewer currents on the chassis of the radio 300 and is, therefore, subjected to less detuning from handling of the phone 300. Another advantage arises from positioning the antenna 200 near the front side 108 of the phone 300 backed by the "partial" ground plane 202, which subjects the antenna 200 to less power dissipation caused by a user's hand due to increased distance and isolation from the user's palm on the back side of the phone 300.

Figure 4:
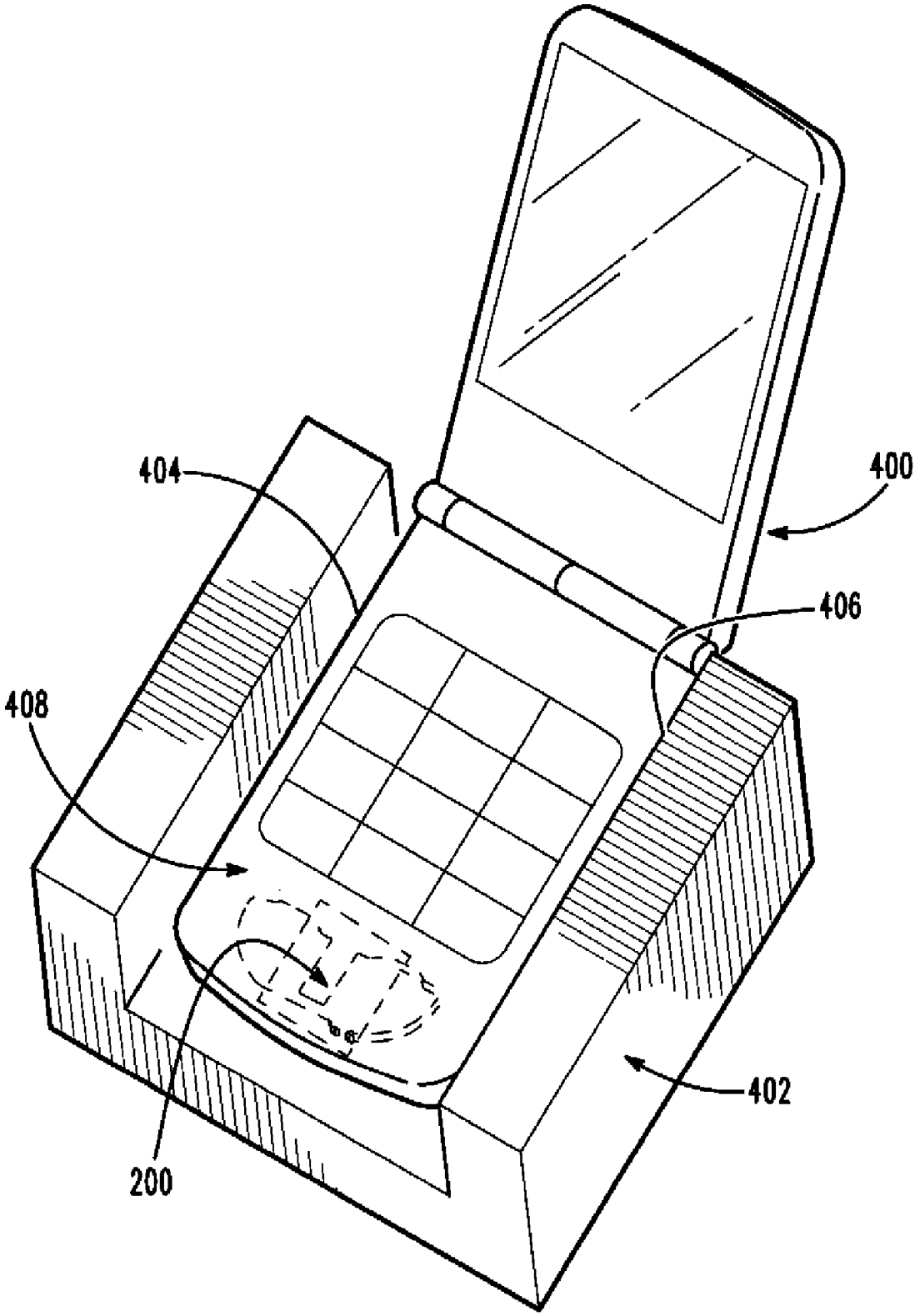
FIG. 4 is a perspective view of the cellular communication device and internal dual-element/multi-frequency band antenna of FIG. 3 placed within a "C" block, according to an embodiment of the present invention.

Table 1 below presents the results of a simulation that compares radiation and system efficiency between the folded dipole antenna of the present invention and a prior-art internal λ/4 wire antenna. The comparison is performed, as is shown in FIG. 4, by placing the phone 400 in a C-shaped block 402 that surrounds the sides 404 and 406 and back (not shown) of a lower portion 408 of the phone 400. The C-shaped block 402 is configured to mimic or simulate loading caused by the presence of a user's hand, i.e., the Dispatch Position.

TABLE 1

| Antenna | Radiation Efficiency (%) | System Efficiency (%) | RL (dB) |
|---|---|---|---|
| Folded Dipole | 31.77 | 30.92 | −15 |
| P.A. λ/4 wire antenna | 21.46 | 15.12 | −5.3 |

Figure 7:
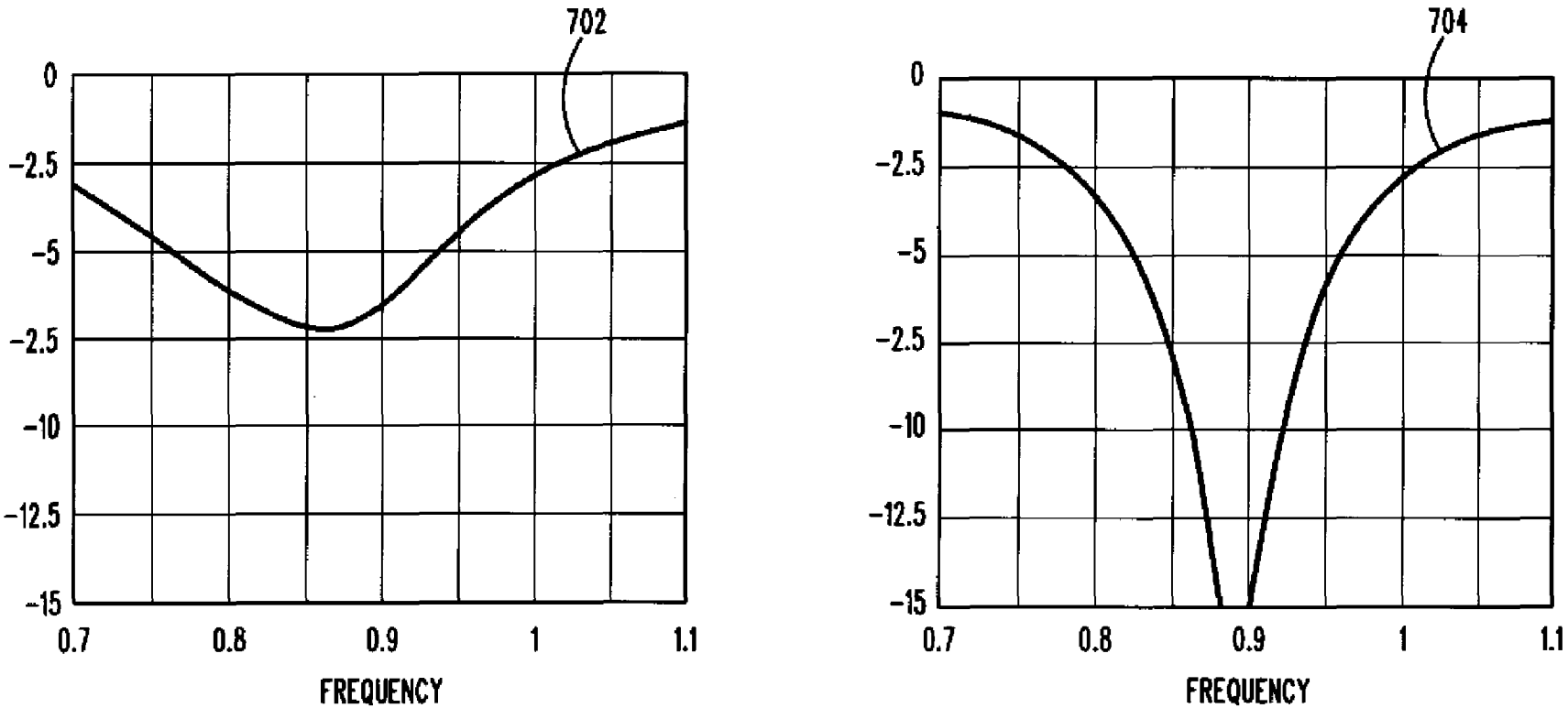
FIG. 7 is a set of graphs showing the frequency response of the present invention vs. the frequency response of a prior art internal $\lambda/4$ wire antenna when placed in the C-block of FIG. 4.

There are two metrics that quantify antenna performance for cellular phones. One metric is Radiation efficiency defined as the radiated efficiency of the antenna excluding mismatch loss. The radiation efficiency metric indicates mainly the effect of detuning and dissipation from a user's hand. The second metric is System efficiency which is the radiation efficiency including mismatch loss. System efficiency indicates the effect of mismatch loss to the antenna. The simulation comparison in the Dispatch Position shows that the folded dipole of the present invention provides an increased radiation efficiency of 1.7 dB (10*LOG (31.77/21.46)) over the prior art internal λ/4 wire antenna design. The folded dipole of the present invention also provides an increased system efficiency of 3.1 dB (10*LOG(30.92/15.12)) over the prior art internal λ/4 wire antenna design. FIG. 7 shows this frequency response 704 of the present invention operating in the C-block 402 compared to the frequency response 702, of a prior-art the prior art internal λ/4 wire antenna operating in the C-block 402.

Referring now back to FIG. 2, a second element 216 is included and is part of the antenna 200. The second element 216 is a λ/4 resonance stub that is tuned to efficiently receive data at the GPS frequency of 1575.42 MHz. As can easily be seen in FIG. 2, the GPS element 216 is also fed at the feed point 212. The second element 216 extends out away from the ground plane 202 for part of its length and then returns back over the ground plane 202, generally following the C-shaped of the second general C-shaped portion 208. The extension away from and then back towards the ground plane 202 provides a variable coupling with the ground plane 202.

The second element 216 is connected to element 204 at the feed point 212 and is electromagnetically coupled to element 204 along its length to match the impedance of element 216 to the desired feed point impedance (typically 50 Ohm). Element 216 can also be a constructed with a meandering conductor in the region of an outer edge of area 208, which is electromagnetically coupled to element 204 and whose overall electrical length is λ/4 at the GPS frequency. The term "meandering," as user herein, means a winding path or course. Element 216 can also be disposed above element 204.

Figure 6:
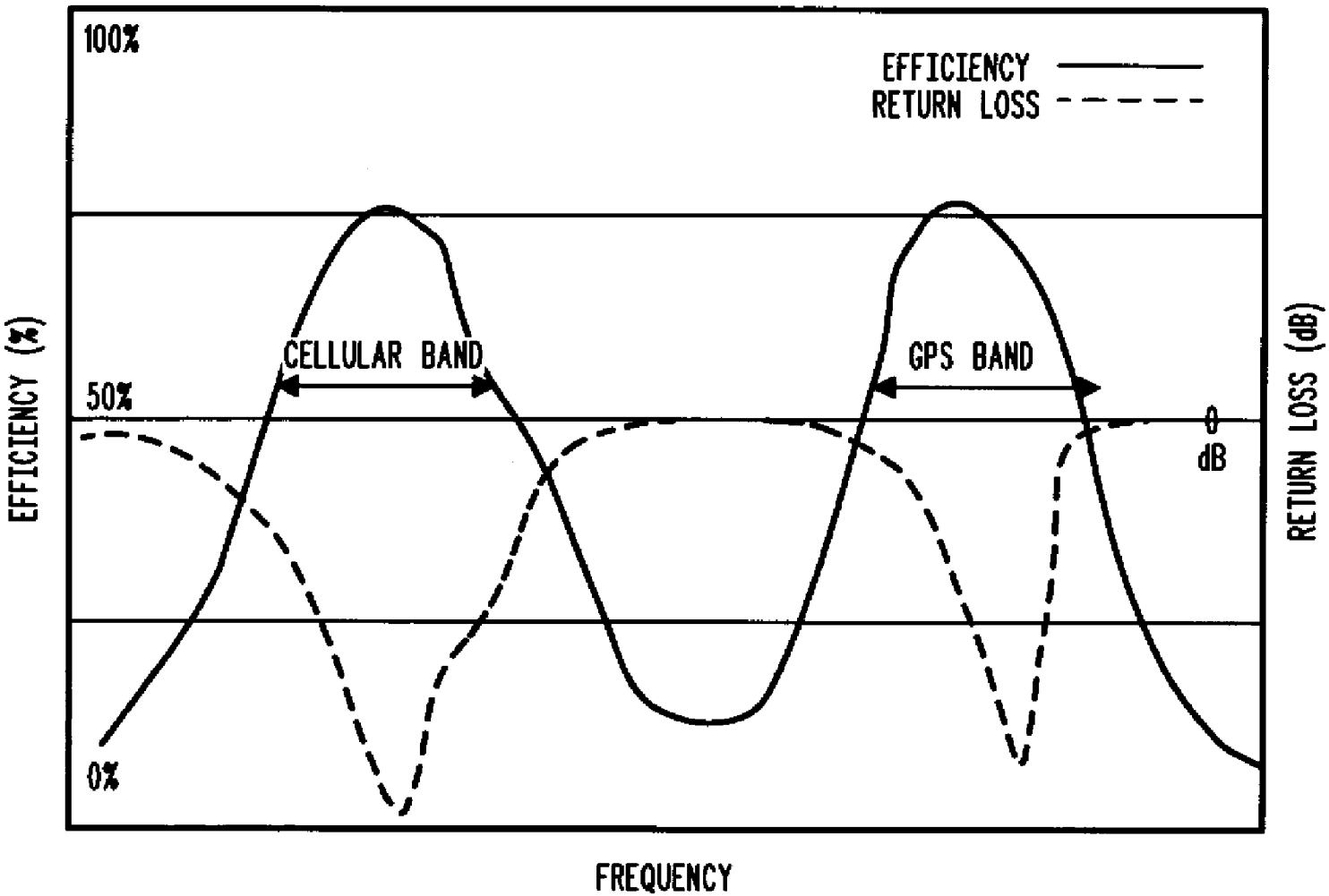
FIG. 6 is a graph showing the performance of the present invention over the Cellular and GPS frequency bands.

FIG. 6 shows an exemplary multi-band frequency response graph of the present invention, as tested. The graph shows that the efficiency of the inventive antenna 200 advantageously peaks in the cellular band and again in the GPS band and has nulls outside of these frequency bands.

Figure 5:
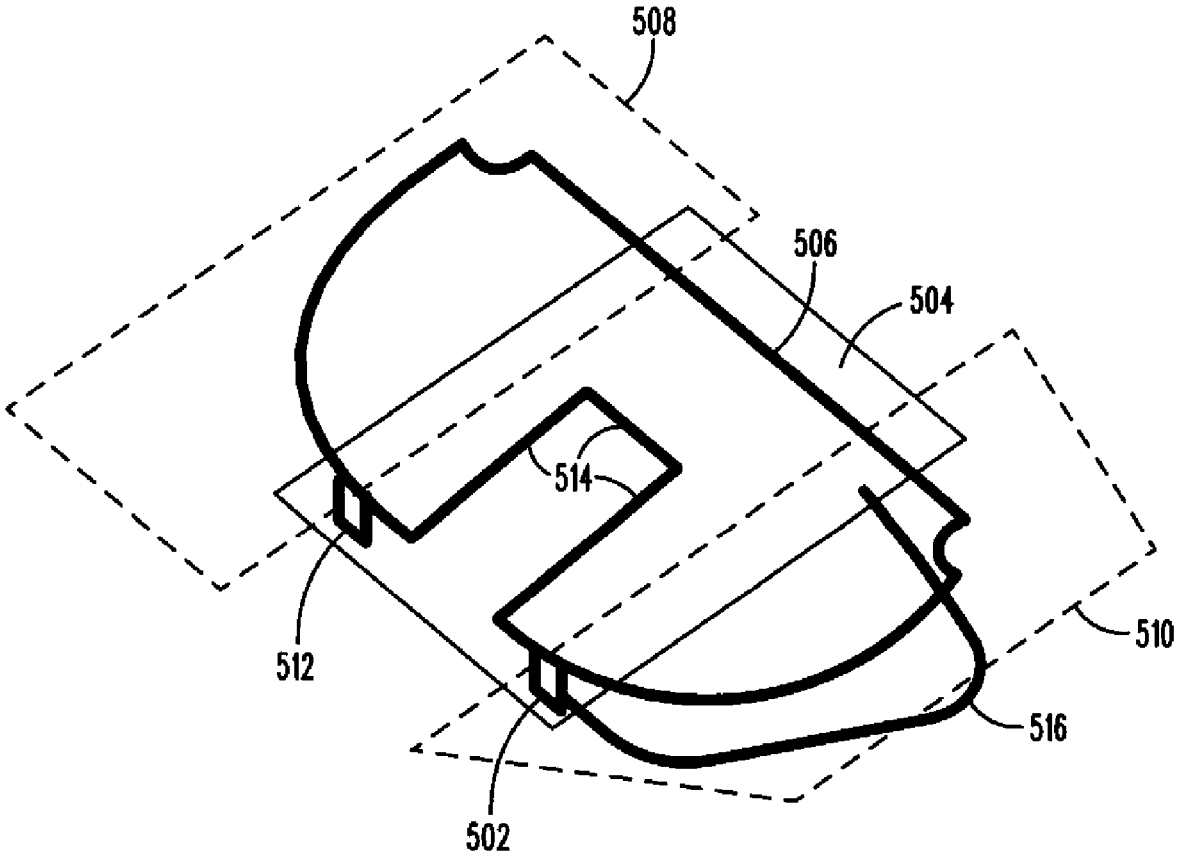
FIG. 5 is a perspective view of a dual-element/multi-frequency band antenna, according to another embodiment of the present invention.

FIG. 5 shows another embodiment of the present invention. In FIG. 5, a first element 506 of the antenna 500 is fed through an input 502 that is adjacent, but electrically isolated from, a partial ground plane 504. The ground plane 504 is defined as "partial" because it is, similar to ground plane 202 in FIG. 2, smaller than the element to which it is coupled.

An element 506 is positioned directly above the ground plane 504 and is spaced away from the ground plane 504, but extends beyond the ground plane 504 on both sides. The element 506 can be made of any suitable radiating material. The element 506 includes two generally C-shaped portions 508 and 510 substantially defining operation in frequency ranges covering the cellular band. In this embodiment, there is no discontinuity between the two generally C-shaped portions 508 and 510. The dotted lines in FIG. 5 generally defines the boundaries of the C-shapes, but are not meant to be exact.

Each of the generally C-shaped portions 508 and 510 is oriented so that the open end of the C-shape is positioned directly above the ground plane 504 and the closed, or curving, part of the C-shape extends away from the ground plane 504. In this configuration, only part of the element 506 feels the affect of the ground plane 504. The antenna 500 also has a ground point 512, where the element 506 is shorted to the ground plane 504.

A transmission line element 514 is provided between the first general "C" shape portion 508 and the second general "C" shape portion 510 and is positioned so that the entire transmission line element 514 is directly above the ground plane 504. In the embodiment illustrated, the transmission line element 514 is rectangular, but the invention is not so limited and can be, for example, square or curved. As can be seen in FIG. 5, the transmission line element 514 is provided in series between the feed point 502 and the ground point 512 and is sandwiched between the two general "C" shaped portions 508 and 510.

The transmission line element 514 is a reactive distributive element that provides length to the overall element 506 as well as electromagnetic coupling to the ground plane 504. The added length provided by the transmission line element 514 extends the overall element length closer to the desirable $\lambda/2$. The electromagnetic coupling provided by the transmission line element 514 also makes the element electrically appear taller than it is, which helps "match" the antenna element 506 to the impedance of air.

One noticeable difference from the embodiment of FIG. 2 is that in the embodiment of FIG. 5, the first general C-shaped portion 508 of the element 506, the second general C-shaped portion of the first element 506, and the transmission line element 514 form a continuous closed electrical loop. In contrast, in the embodiment of FIG. 2, there is a discontinuity in the direct path between the feed point 212 and the ground point 214.

In the particular embodiment shown in FIG. 5, similar to the embodiment of FIG. 2, the two general C-shaped portions 508 and 510 are substantially mirror symmetrical with each other. However, symmetry between the C-shapes is not necessary and the present invention is not so limited.

The embodiment of FIG. 5 also includes a GPS element 516. The GPS element 516 is a $\lambda/4$ resonance stub that is tuned to efficiently communicate in the GPS frequency range. As can be easily seen in FIG. 5, the GPS element 516 is also fed at the feed point 502. The GPS element 516 extends out away from the ground plane 504 for part of its length and then returns back over the ground plane 504, generally following the C-shape of the second general C-shaped portion 510. The extension away from and then back towards the ground plane 504 provides variable coupling with the ground plane 504.

CONCLUSION

As should now be clear, embodiments of the present invention provide a multi-band antenna that exceeds cellular band and UPS antenna performance specifications, as well as the performance of traditional antennas, such as the prior art internal $\lambda/4$ wire antenna. The inventive antenna advantageously provides a half wavelength cellular band element that is fits within the interior of a phone and is minimally impacted by the user's hand during operation. In addition, the shape of the antenna does not interfere with existing component located within several models of cellular phones.

Non-Limiting Examples

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A loop antenna comprising:

a ground plane; and a conductive element that includes:

a first C-shaped element portion having an open end and a closed end, with only the open end extending directly above a first portion of the ground plane;

a second C-shaped element portion having an open end and a closed end, with only the open end extending directly above a second portion of the ground plane; and a transmission line element disposed between the first C-shaped element portion and the second C-shaped element portion and positioned directly above a third portion of the ground plane.

2. The loop antenna according to claim 1, wherein:

the first C-shaped element portion has a first end and the second C-shaped element portion has a second end; and the transmission line element is in a series connection between the first end of the first C-shaped element portion and the second end of the second C-shaped element portion.

3. The loop antenna according to claim 1, wherein:

the first C-shaped element portion is symmetrical with the second C-shaped element portion.

4. The loop antenna according to claim 1, wherein:

the transmission line element is a reactive distributive element.

5. The loop antenna according to claim 1, wherein:

conductive element is a folded dipole.

6. The loop antenna according to claim 1, wherein:

the transmission line element is substantially rectangular.

7. The loop antenna according to claim 1, further comprising:

a stub element coupled to the conductive element at a feedpoint of the conductive element and one of generally follows the shape of one of the C-shaped element portions and meanders in a proximity of one of the C-shaped element portions.

8. The loop antenna according to claim 1, further comprising:

a handset supporting and containing the element and the ground plane, the handset having a first side to face a user's head during use and a second side to face a user's hand during use, wherein the ground plane is disposed between the first side and the second side and the element is disposed between the first side and the ground plane.

9. The loop antenna according to claim 1, wherein:

the first element portion, the second element portion, and the transmission line element form a continuous closed electrical loop.

10. The loop antenna according to claim 1, wherein:

the closed end of the first element portion extends beyond and edge of the ground plane.

11. The loop antenna according to claim 1, wherein:

the first element, the second element, and the transmission line element are continuous.

12. The loop antenna according to claim 1, wherein:

the first, second, and third portions of the ground plane are different.

13. The loop antenna according to claim 1, wherein:

the first, second, and third portions of the ground plane are adjacent one another.

14. The loop antenna according to claim 1, wherein:

the first and second portions of the ground plane are on opposing sides of the third portion.

15. A wireless communication device comprising:

a first side with user-interactable components;

a second side to be supported by a user's hand;

a ground plane disposed between the first side and the second side and having outer edges; and a conductive element located between the first side and the ground plane, the conductive element including:

a first element portion forming a C-shape with an open end directly above a first portion of the ground plane and a closed end extending beyond at least one edge of the ground plane;

a second element portion forming a C-shape with an open end directly above a second portion of the ground plane and a closed end extending beyond at least one edge of the ground plane; and a transmission line element connecting the first element portion to the second element portion and positioned directly above a third portion of the ground plane.

16. The wireless communication device according to claim 15, wherein:

the first and second C-shaped element portions are partially above the ground plane and the transmission line element is entirely above the ground plane.

17. The wireless communication device according to claim 15, further comprising:

an antenna feed point at a first end of the transmission line element; and a ground point at a second end of the transmission line element, the ground point making a direct electrical connection between the conductive element and the ground plane.

18. The wireless communication device according to claim 17, further comprising:

a stub element that includes:

a first end electrically coupled to the feedpoint;

a length that generally follows the C-shape of the first element portion; and a second end positioned directly above the first portion of the ground plane.

19. The wireless communication device according to claim 15, wherein:

the first element portion has a first end;

the first element portion has a second end opposing the first end;

the second element portion has a first end;

the second element portion has a second end opposing the first end of the second element portion and is coupled to the second end of the first element portion;

an antenna feed point is at the first end of the first element portion; and a ground point is at the first end of the second element portion.

20. The wireless communication device according to claim 19, wherein:

the transmission line element electrically couples the second end of the first element portion to the second end of the second element portion.

* * * * *